US008361946B2

(12) United States Patent
Greenwood et al.

(10) Patent No.: US 8,361,946 B2
(45) Date of Patent: Jan. 29, 2013

(54) DETERGENT COMPOSITION

(75) Inventors: Peter Greenwood, Gothenburg (SE); Hans Lagnemo, Gothenburg (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 11/100,634

(22) Filed: Apr. 7, 2005

(65) Prior Publication Data

US 2005/0233937 A1 Oct. 20, 2005

Related U.S. Application Data

(60) Provisional application No. 60/560,262, filed on Apr. 8, 2004.

(51) Int. Cl.
*C11D 3/08* (2006.01)

(52) U.S. Cl. ..... 510/180; 510/181; 510/189; 510/220; 510/222; 510/235; 510/238; 510/243; 510/347; 510/418; 510/466; 510/511

(58) Field of Classification Search ..... 510/180, 510/181, 189, 220, 222, 235, 238, 243, 347, 510/418, 466, 511
See application file for complete search history.

(56) References Cited

U.S. PATENT DOCUMENTS

| | | | | | |
|---|---|---|---|---|---|
| 2,630,410 | A | | 3/1953 | Clapsadle | |
| 3,128,287 | A | | 4/1964 | Berg | |
| 3,308,067 | A | | 3/1967 | Diehl | |
| 3,635,830 | A | | 1/1972 | Lamberti et al. | |
| 3,723,322 | A | | 3/1973 | Diehl | |
| 3,835,163 | A | | 9/1974 | Rapko | |
| 3,923,679 | A | | 12/1975 | Rapko | |
| 3,929,678 | A | | 12/1975 | Laughlin et al. | |
| 4,102,903 | A | | 7/1978 | Crutchfield et al. | |
| 4,120,874 | A | | 10/1978 | Crutchfield et al. | |
| 4,144,226 | A | | 3/1979 | Crutchfield et al. | |
| 4,158,635 | A | | 6/1979 | Crutchfield et al. | |
| 4,228,044 | A | | 10/1980 | Cambre | |
| 4,274,883 | A | * | 6/1981 | Lumbeck et al. | 106/490 |
| 4,425,403 | A | * | 1/1984 | Taniguchi et al. | 428/331 |
| 4,469,743 | A | * | 9/1984 | Hiss | 428/215 |
| 4,478,909 | A | * | 10/1984 | Taniguchi et al. | 428/331 |
| 4,525,421 | A | * | 6/1985 | Kubota et al. | 428/412 |
| 4,566,984 | A | | 1/1986 | Bush | |
| 4,590,117 | A | * | 5/1986 | Taniguchi et al. | 428/212 |
| 4,611,892 | A | * | 9/1986 | Kawashima et al. | 351/159 |
| 4,663,071 | A | | 5/1987 | Bush et al. | |
| 4,801,401 | A | | 1/1989 | Schulz et al. | |
| 4,927,749 | A | | 5/1990 | Dorn | |
| 4,978,471 | A | * | 12/1990 | Starch | 516/119 |
| 5,001,183 | A | * | 3/1991 | Sands et al. | 524/493 |
| 5,368,833 | A | | 11/1994 | Johansson et al. | |
| 5,760,126 | A | * | 6/1998 | Engle et al. | 524/516 |
| 5,846,650 | A | * | 12/1998 | Ko et al. | 428/336 |
| 5,911,974 | A | * | 6/1999 | Brieva et al. | 424/64 |
| 5,919,298 | A | * | 7/1999 | Griffith et al. | 106/490 |
| 5,942,590 | A | * | 8/1999 | Burns et al. | 528/10 |
| 5,968,889 | A | * | 10/1999 | Wierenga | 510/423 |
| 6,015,843 | A | * | 1/2000 | Van Vlasselaer et al. | 522/84 |
| 6,034,047 | A | * | 3/2000 | Au et al. | 510/372 |
| 6,051,672 | A | * | 4/2000 | Burns et al. | 528/10 |
| 6,090,439 | A | * | 7/2000 | Menon et al. | 427/215 |
| 6,228,499 | B1 | * | 5/2001 | Nakauchi et al. | 428/412 |
| 6,265,029 | B1 | * | 7/2001 | Lewis | 427/378 |
| 6,376,067 | B1 | * | 4/2002 | Heberger et al. | 428/336 |
| 6,506,496 | B1 | * | 1/2003 | Frugier et al. | 428/447 |
| 6,617,303 | B1 | | 9/2003 | Smith et al. | |
| 7,217,440 | B2 | * | 5/2007 | Jallouli et al. | 427/162 |
| 2002/0111287 | A1 | * | 8/2002 | Bauer et al. | 510/445 |
| 2002/0192367 | A1 | * | 12/2002 | Barbuzzi et al. | 427/180 |
| 2003/0064907 | A1 | * | 4/2003 | Jeffrey et al. | 510/374 |
| 2003/0193037 | A1 | * | 10/2003 | Koyanagi et al. | 252/1 |
| 2004/0005991 | A1 | * | 1/2004 | Boucher et al. | 510/235 |
| 2004/0077768 | A1 | * | 4/2004 | Greenwood | 524/492 |
| 2004/0204336 | A1 | * | 10/2004 | Himmrich et al. | 510/504 |
| 2006/0115405 | A1 | * | 6/2006 | Konya et al. | 423/337 |
| 2009/0163400 | A1 | * | 6/2009 | Sierkstra et al. | 510/392 |

FOREIGN PATENT DOCUMENTS

| | | | |
|---|---|---|---|
| EP | 0564476 | B1 | 4/1995 |
| EP | 0200263 | B2 | 10/1995 |
| EP | 0 929639 | B1 | 11/2002 |
| WO | WO 91/09100 | | 6/1991 |
| WO | WO 94/23005 | | 10/1994 |
| WO | WO 99/36359 | | 7/1999 |
| WO | WO 01/83662 | A1 | 11/2001 |

OTHER PUBLICATIONS

Iler, K. Ralph, "The Chemistry of Silica", John Wiley & Sons (1979), pp. 407-409.

Iler, K. Ralph et al, "Degree of Hydration of Particles of Colloidal Silica in Aqueous Solution", Grasselli Chemicals Dept., 1968, 2 pages.

Hatfield, Marshall R. et al, "Applicationof the Absolute Rate Theory to Adhesion", Central Research Dept., Minnesota Mining & Manufacturing Co., 1984, 2 pages.

European Search Report, completed Aug. 18, 2004.

Office Action for Japanese Patent Application No. 2007-507268 dated Mar. 2, 2010.

English language translation for Japanese Patent Application No. 2007-507268 dated Mar. 2, 2010.

* cited by examiner

*Primary Examiner* — Charles Boyer
(74) *Attorney, Agent, or Firm* — Robert C. Morriss

(57) ABSTRACT

The invention relates to a method of preparing an aqueous detergent dispersion comprising mixing at least one silane compound, colloidal silica particles, and a detergent to form an aqueous detergent dispersion comprising silanized colloidal silica particles. The invention also relates to a dispersion obtainable by the method and to the use thereof.

20 Claims, No Drawings

DETERGENT COMPOSITION

This application claims priority from U.S. Provisional Application No. 60/560,262, filed on Apr. 8, 2004, the subject matter of which is incorporated herein by reference.

The present invention relates to a detergent composition comprising silane-modified silica particles.

BACKGROUND OF THE INVENTION

Detergent compositions are currently being used in many cleaning applications including cleaning of hard and soft surfaces e.g. textile, and many other applications in household and industrial use.

U.S. patent application 2002/0111287 A1 discloses a method of providing a detergent composition comprising hydrophilic silicate-containing particles. However, it has been found that these kinds of detergent compositions are not always sufficiently stable and may be liable to precipitation over time which of course is detrimental to the cleaning effect.

Thus, it would be desirable to provide a stable and preferably highly concentrated aqueous detergent dispersion that can be used in the above mentioned applications. It would also be desirable to provide a convenient and inexpensive method of producing such dispersion.

THE INVENTION

The invention relates to a method of preparing an aqueous detergent dispersion comprising mixing at least one silane compound, colloidal silica particles, and a detergent to form an aqueous detergent dispersion comprising silanized colloidal silica particles.

This method can be performed without environmental hazard and health problems for process operators handling the components of the forming aqueous detergent dispersion.

The mixing of silane and colloidal silica particles is preferably carried out continuously, preferably at a temperature from about 20 to about 95, more preferably from about 50 to about 75, and most preferably from about 60 to about 70° C. Preferably, silane is slowly added to the silica particles under vigorous agitation at a temperature of about 60° C. and at a controlled rate, which suitably is from about 0.01 to about 100, preferably from about 0.1 to about 10, more preferably from about 0.5 to about 5, and most preferably from about 1 to about 2 silane molecules per $nm^2$ colloidal silica surface area (on the colloidal silica particles) and hour. The addition of silane can be continued for any suitable time depending on the addition rate, amount of silane to be added, and degree of desired silanisation. However, the addition of silane is preferably continued for about 5 hours, more preferably for about 2 hours until a suitable amount of silane has been added. The amount of added silane to the colloidal silica particles suitably is from about 0.1 to about 6, preferably from about 0.3 to about 3, and most preferably from about 1 to about 2 silane molecules per $nm^2$ surface area of the colloidal silica particles. Continuous addition of silane to the colloidal particles may be particularly important when preparing highly concentrated silanized silica sol dispersions having a silica content up to about 80 wt %. However, the silica content suitably is from about 20 to about 80, preferably from about 25 to about 70, and most preferably from about 30 to about 60 wt %.

Preferably, colloidal silica particles and silane are mixed in a weight ratio of silane to silica of from about 0.01 to about 1.5, more preferably from about 0.05 to about 1, and most preferably from about 0.1 to about 0.5.

Preferably, the silane compound(s) is diluted before mixing it with the colloidal silica particles, preferably with water to form a premix of silane and water, suitably in a weight ratio of from about 1:8 to about 8:1, preferably from about 3:1 to about 1:3, and most preferably from about 1.5:1 to about 1:1.5. The resulting silane-water solution is substantially clear and stable and easy to mix with the colloidal silica particles. At continuous addition of silane to the colloidal silica particles, the mixing preferably continues from about 1 second to about 30 minutes, preferably from about 1 minute to about 10 minutes after the addition of silane stopped.

According to one embodiment, no organosiloxane or silicone are admixed in the aqueous dispersion for preparing a silicone coat on any silica particles or silane-modified silica particles The mixing according to the invention may be carried out at a pH from about 1 to about 13, preferably from about 6 to about 12, more preferably from about 7.5 to about 11, and most preferably from about 9 to about 10.5.

By the term "stable", particularly in the context of a "stable dispersion" is meant a stable compound, mixture or dispersion that does not substantially gel or precipitate within a period of preferably at least about 2 months, more preferably at least about 4 months, and most preferably at least about 5 months at normal storage in room temperature, i.e. at a temperature from about 15 to about 35° C.

Preferably, the relative increase in viscosity of the dispersion two months after the preparation thereof is lower than about 100%, more preferably lower than about 50%, and most preferably lower than about 20%. Preferably, the relative increase in viscosity of the dispersion four months after the preparation thereof is lower than about 200%, more preferably lower than about 100%, and most preferably lower than about 40%.

Colloidal silica particles, also referred to as silica sols herein, may be derived from e.g. precipitated silica, micro silica (silica fume), pyrogenic silica (fumed silica) or silica gels with sufficient purity, and mixtures thereof.

Colloidal silica particles and silica sols according to the invention may be modified and can contain other elements such as amines, aluminium and/or boron, which can be present in the particles and/or the continuous phase. Boron-modified silica sols are described in e.g. U.S. Pat. No. 2,630,410. The aluminium modified silica particles suitably have an $Al_2O_3$ content of from about 0.05 to about 3 wt %, preferably from about 0.1 to about 2 wt %. The procedure of preparing an aluminium modified silica sol is further described in e.g. "The Chemistry of Silica", by Iler, K. Ralph, pages 407-409, John Wiley & Sons (1979) and in U.S. Pat. No. 5,368,833.

The colloidal silica particles suitably have an average particle diameter ranging from about 2 to about 150 nm, preferably from about 3 to about 50 nm, and most preferably from about 5 to about 40 nm. Suitably, the colloidal silica particles have a specific surface area from about 20 to about 1500, preferably from about 50 to about 900, and most preferably from about 70 to about 600 $m^2/g$.

The colloidal silica particles preferably have a narrow particle size distribution, i.e. a low relative standard deviation of the particle size. The relative standard deviation of the particle size distribution is the ratio of the standard deviation of the particle size distribution to the mean particle size by numbers. The relative standard deviation of the particle size distribution preferably is lower than about 60% by numbers, more preferably lower than about 30% by numbers, and most preferably lower than about 15% by numbers.

The colloidal silica particles are suitably dispersed in an aqueous solvent, suitably in the presence of stabilising cations such as $K^+$, $Na^+$, $Li^+$, $NH_{4+}$, organic cations, primary, secondary, tertiary, and quaternary amines, or mixtures thereof so as to form an aqueous silica sol. However, also dispersions comprising organic solvents, e.g. lower alcohols, acetone or mixtures thereof may be used, suitably in an amount of from about 1 to about 20, preferably from about 1 to about 10, and most preferably from about 1 to about 5 volume percent of the total solvent volume. However, aqueous silica sols without any further solvents are preferably used. Preferably, the colloidal silica particles are negatively charged. Suitably, the silica content in the sol is from about 20 to about 80, preferably from about 25 to about 70, and most preferably from about 30 to about 60 wt %. The higher the silica content, the more concentrated the resulting silanized colloidal silica dispersion. The pH of the silica sol suitably is from about 1 to about 13, preferably from about 6 to about 12, and most preferably from about 7.5 to about 11. However, for aluminium-modified silica sols, the pH suitably is from about 1 to about 12, preferably from about 3.5 to about 11.

The silica sol preferably has an S-value from about 20 to about 100, more preferably from about 30 to about 90, and most preferably from about 60 to about 90.

It has been found that dispersions with an S-value within these ranges can improve the stability of the resulting dispersion. The S-value characterises the extent of aggregation of colloidal silica particles, i.e. the degree of aggregate or microgel formation. The S-value has been measured and calculated according to the formulas given in J. Phys. Chem. 60(1956), 955-957 by Iler, R. K. & Dalton, R. L.

The S-value depends on the silica content, the viscosity, and the density of the colloidal silica particles. A high S-value indicates a low microgel content. The S-value represents the amount of $SiO_2$ in percent by weight present in the dispersed phase of e.g. a silica sol. The degree of microgel can be controlled during the production process as further described in e.g. U.S. Pat. No. 5,368,833.

The silane compounds can form stable covalent siloxane bonds (Si—O—Si) with the silanol groups or be linked to the silanol groups, e.g. by hydrogen bondings, on the surface of the colloidal silica particles. Thus, by this method, the silica particles are surface-modified.

Suitable silane compounds include tris-(trimethoxy)silane, octyl triethoxysilane, methyl triethoxysilane, methyl trimethoxysilane; isocyanate silane such as tris-[3-(trimethoxysilyl)propyl]isocyanurate; gamma-mercaptopropyl trimethoxysilane, bis-(3-[triethoxysilyl]propyl)polysulfide, beta-(3,4-epoxycyclohexyl)-ethyl trimethoxysilane; silanes containing an epoxy group (epoxy silane), glycidoxy and/or a glycidoxypropyl group such as gamma-glycidoxypropyl trimethoxysilane, gamma-glycidoxypropyl methyldiethoxysilane, (3-glycidoxypropyl)trimethoxy silane, (3-glycidoxypropyl) hexyltrimethoxy silane, beta-(3,4-epoxycyclohexyl)-ethyltriethoxysilane; silanes containing a vinyl group such as vinyl triethoxysilane, vinyl trimethoxysilane, vinyl tris-(2-methoxyethoxy)silane, vinyl methyldimethoxysilane, vinyl triisopropoxysilane; gamma-methacryloxypropyl trimethoxysilane, gamma-methacryloxypropyl triisopropoxysilane, gamma-methacryloxypropyl triethoxysilane, octyltrimethyloxy silane, ethyltrimethoxy silane, propyltriethoxy silane, phenyltrimethoxy silane, 3-mercaptopropyltriethoxy silane, cyclohexyltrimethoxy silane, cyclohexyltriethoxy silane, dimethyldimethyoxy silane, 3-chloropropyltriethoxy silane, 3-methacryoxypropyltrimethoxy silane, i-butyltriethoxy silane, trimethylethoxy silane, phenyldimethylethoxy silane, hexamethyldisiloxane, trimethylsilyl chloride, vinyltriethoxy silane, hexamethyldisilizane, and mixtures thereof. U.S. Pat. No. 4,927,749 discloses further suitable silanes which may be used in the present invention. The most preferred silanes, however, are epoxy silanes and silane compounds containing a glycidoxy or glycidoxypropyl group, particularly gamma-glycidoxypropyltrimethoxysilane and/or gamma glycidoxypropyltmethyldiethoxysilane.

By the term detergent is meant all ingredients the detergent may be made up of and which may be present in the prepared aqueous detergent dispersion. This may include surfactants, builders, co-builders, fillers, enzymes, pH regulators, hydrophilising agents, optical brighteners, anti-dye transition agents such as e.g. CMC, bleaching chemicals such as e.g. hydrogen peroxide, activators, complexing agents, softening agents, perfumes, viscosity modifiers and other ingredients typically used in liquid detergents. Furthermore, any detergent ingredients as mentioned in WO01/83662, U.S. Pat. No. 6,617,303, EP 929639, WO 91/09100 or U.S. 2002/0111287 appearing in liquid detergents may also be used.

Preferably, the detergent is added after the silanized or silane-modified silica particles have formed. The detergent is preferably mixed with the silanized colloidal silica particles at room temperature.

The preferred detergent ingredients mixed with the silane-modified silica particles will in the following be described more in detail. Preferably, the detergent, i.e. the total weight of the detergent ingredients is mixed to yield a total detergent content in the formed aqueous detergent dispersion of about 2 to about 80 wt %. According to one embodiment, the total detergent content in the aqueous detergent dispersion is preferably from about 2 to about 10, most preferably from about 2 to about 5 wt %. According to another embodiment, the total detergent content in the aqueous detergent dispersion is preferably from about 50 to about 80, most preferably from about 60 to about 70 wt %. According to yet another embodiment, the total detergent content in the aqueous detergent dispersion is preferably from about 30 to about 50, most preferably from about 40 to about 50 wt %.

The surfactants or interface-active substances may be anionic, non-ionic, cationic, amphoteric, and/or zwitterionic surfactants.

Suitable anionic surfactants of the sulphonate type are preferably the known ($C_9$-$C_{13}$)-alkylbenzenesulphonates, alpha-olefinsulphonates and alkanesulphonates. Also suitable are esters of sulpho fatty acids or the disalts of alpha-sulpho fatty acids. Further suitable anionic surfactants are sulphated fatty acid glycerol esters, which are mono-, di- and triesters and mixtures thereof, as are obtained during the preparation by esterification by 1 mol of monoglycerol with 1 to 3 mol of fatty acid or in the transesterification of triglycerides with 0.3 to 2 mol of glycerol. Suitable alkyl sulphates are, in particular, the sulfuric monoesters of ($C_{12}$-$C_{18}$)-fatty alcohols, such as lauryl alcohol, myristyl alcohol, cetyl alcohol or stearyl alcohol, and the fatty alcohol mixtures obtained from coconut oil, palm oil and palm kernel oil which may additionally comprise fractions of unsaturated alcohols, e.g. oleyl alcohol.

Further suitable anionic surfactants may for example be selected from alcohol-ethoxysulphates, alkali metal sarcosinates or alkyl ester sulfonates.

Suitable further anionic surfactants are, in particular, soaps. Saturated fatty soaps, such as the salts of lauric acid, myristic acid, palmitic acid, stearic acid, hydrogenated erucic acid and behenic acid, and, in particular, soap mixtures derived from natural fatty acids, e.g. coconut, palm kernel or tallow fatty acids, are suitable. The anionic surfactants can be in the form of their sodium, potassium or ammonium salts, and in the form of soluble salts of organic bases, such as mono-, di- or triethanolamine. The anionic surfactants are preferably in the form of their sodium or potassium salts, in particular in the form of the sodium salts.

Particularly preferred nonionic surfactants are alkyl alkoxylates, gluconamides and alkyl polyglycosides. Of the alkyl alkoxylates, preference is given to using ethoxylated alcohols. Preferred ethoxylated alcohols include, for example, $C_{11}$-alcohols having 3, 5, 7, 8 and 11 EO units, ($C_{12}$-$C_{15}$)-alcohols having 3, 6, 7, 8, 10 or 13 EO units, ($C_{14}$-$C_{15}$)-alcohols having 4, 7 or 8 EO units, ($C_{16}$-$C_{18}$)-alcohols having 8, 11, 15, 20, 25, 50 or 80 EO units and mixtures thereof. The degrees of ethoxylation given are statistical average values which may be an integer or a fractional number for a specific product. In addition to these, it is also possible to use fatty alcohol-EO/PO adducts, such as, for example, the Genapol® grades 3970, 2909 and 2822 from Clariant GmbH. Further suitable surfactants are polyhydroxy fatty acid amides of the formula $R_2$—CO—N($R_3$)—Z, in which $R_2$CO is an aliphatic acyl radical having 6 to 22 carbon atoms, $R_3$ is hydrogen, an alkyl or hydroxyalkyl radical having 1 to 4 carbon atoms and Z is a linear or branched polyhydroxyalkyl radical having 3 to 10 carbon atoms and 3 to 10 hydroxyl groups. Preferably, alkyl glycosides of the formula $RO(G)_x$ can be used, in which R is a primary straight-chain or methyl-branched, in particular methyl-branched in the 2-position, aliphatic radical having 8 to 22, preferably 12 to 18, carbon atoms, and G is a glycose unit having 5 or 6 carbon atoms, preferably glucose. The degree of oligomerization x, which indicates the distribution of monoglycosides and oligoglycosides, is any desired number between 1 and 10; preferably 1.2 to 1.4. Preference is also given to alkoxylated, preferably ethoxylated or ethoxylated and propoxylated, fatty acid alkyl esters, preferably having 1 to 4 carbon atoms in the alkyl chain.

Examples of suitable cationic surfactants are quaternary ammonium compounds, cationic polymers and emulsifiers of the type used in hair care preparations and also in fabric conditioners. Cationic surfactants include the ammonium surfactants such as alkyldimethylammonium halogenides, and those surfactants having the formula $[R^2(OR^3)_y][R^4(OR^3)_y]_2R^5N^+X^-$ wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$-$C_4$ alkyl, $C_1$-$C_4$ hydroxyalkyl, benzyl, ring structures formed by joining the two $R^4$ groups, —$CH_2$ CHOHCHOHCOR$^6$CHOH—$CH_2$OH wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980.

Ampholytic surfactants can be incorporated into the detergent dispersion. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, lines 18-35 for examples of ampholytic surfactants. Zwitterionic surfactants can also be incorporated into the detergent dispersion. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48 for examples of zwitterionic surfactants. Ampholytic and zwitterionic surfactants are generally used in combination with one or more anionic and/or nonionic surfactants.

The builders are preferably crystalline alumino silicates, alkali metal carbonates, bicarbonates, sesquicarbonates, phosphates such as alkali metal orthophosphates, alkali metal pyrophosphates and alkali metal polyphosphates such as tripolyphosphates, ammonium, crystalline phyllosilicates, crystalline alkali metal silicates without a layer structure and/or X-ray amorphous alkali metal silicates, zeolites such as Zeolite A (e.g. Zeolite 4A), Zeolite B, Zeolite P, Zeolite X, or Zeolite HS, Zeolite MAP, silicates such as crystalline layered disilicates (e.g. of the formula $NaMSI_{x+1}yH_2O$ wherein M is sodium or hydrogen, x is a number from 1.9 to 4 and y is a number from 0 to 20), amorphous disilicates (e.g. Britesil™), polycarboxylates, citrates, sulphates, borates or mixtures thereof. Organic detergent builders preferred for the purposes of the present invention include a wide variety of polycarboxylate compounds. As used herein, "polycarboxylate" refers to compounds having a plurality of carboxylate groups, preferably at least 3 carboxylates. Polycarboxylate builder can generally be added to the dispersion in acid form, but can also be added in the form of a neutralized salt. When utilized in salt form, alkali metals, such as sodium, potassium, and lithium, or alkanolammonium salts are preferred. included among the polycarboxylate builders are a variety of categories of useful materials. One important category of polycarboxylate builders encompasses the ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1964, and Lamberti et al., U.S. Pat. No. 3,635,830, issued Jan. 18, 1972.

A specific type of ether polycarboxylates useful as builders in the present invention also include those having the general formula: CH(A)(COOX)—CH(COOX)—O—CH(COOX)—CH(COOX)(B) wherein A is H or OH; B is H or —O—CH(COOX)—$CH_2$(COOX); and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is —O—CH(COOX)—$CH_2$(COOX), then the compound is tartrate disuccinic acid (TDS) and its water-soluble salts. Mixtures of these builders are especially preferred for use herein. Particularly preferred are mixtures of TMS and TDS in a weight ratio of TMS to TDS of from about 97:3 to about 20:80. These builders are disclosed in U.S. Pat. No. 4,663,071, issued to Bush et al., on May 5, 1987.

Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates represented by the structure: HO—$[C(R)(COOM)-C(R)(COOM)-O]_n$—H wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{14}$ substituted alkyl (preferably R is hydrogen).

Still other ether polycarboxylates include copolymers of maleic anhydride with ethylene or vinyl methyl ether, 1,3,5-trihydroxy benzene-2,4,6-trisulphonic acid, and carboxymethyloxysuccinic acid.

Organic polycarboxylate builders also include the various alkali metal, ammonium and substituted ammonium salts of polyacetic acids. Examples include the sodium, potassium, lithium, ammonium and substituted ammonium salts of ethylenediamine tetraacetic acid, and nitrilotriacetic acid.

Also included are polycarboxylates such as mellitic acid, succinic acid, oxydisuccinic acid, polymaleic acid, benzene 1,3,5-tricarboxylic acid, and carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations, but can also be used in granular dispersions.

Other carboxylate builders include the carboxylated carbohydrates disclosed in U.S. Pat. No. 3,723,322, Diehl, issued Mar. 28, 1973.

Also suitable in the detergent ingredients of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$-$C_{20}$ alkyl succinic acids and salts thereof. A particularly preferred compound of this type is dodecenylsuccinic acid. Alkyl succinic acids typically are of the general formula R—CH(COOH)$CH_2$(COOH) i.e., derivatives of succinic acid, wherein R is hydrocarbon, e.g., $C_{10}$-$C_{20}$ alkyl or alkenyl, preferably $C_{12}$-$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 0,200,263, published Nov. 5, 1986.

Examples of useful builders also include sodium and potassium carboxymethyloxymalonate, carboxymethyloxysuccinate, cis-cyclo-hexane-hexacarboxylate, cis-cyclopentane-tetracarboxylate, water-soluble polyacrylates (these polyacrylates having molecular weights to above about 2,000 can also be effectively utilized as dispersants), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Polycarboxylate builders are also disclosed in U.S. Pat. No. 3,308,067, Diehl, issued Mar. 7, 1967. Such materials include the water-soluble salts of homo- and copolymers of aliphatic carboxylic acids such as maleic acid, itaconic acid and methylenemalonic acid.

Other organic builders known in the art can also be used. For example, monocarboxylic acids, and soluble salts thereof, having long chain hydrocarbyls can be utilized. These would include materials generally referred to as "soaps." Chain lengths of $C_{10}$-$C_{20}$ are typically utilized. The hydrocarbyls can be saturated or unsaturated.

Examples of such carboxylic acids are citric acid, adipic acid, succinic acid, glutaric acid, malic acid, tartaric acid, maleic acid, fumaric acid, sugar acids, aminocarboxylic acids, nitrilotriacetic acid (NTA), providing its use is not ecologically unsafe, and mixtures thereof. Preferred salts are the salts of the polycarboxylic acids, such as citric acid, adipic acid, succinic acid, glutaric acid, tartaric acid, sugar acids and mixtures thereof. The acids per se may also be used. Besides their builder effect, the acids also typically have the property of an acidifying component and, hence, also serve to establish a relatively low and mild pH value in detergents. Citric acid, succinic acid, glutaric acid, adipic acid, gluconic acid and mixtures thereof are particularly mentioned in this regard.

The hydrophilizing agents are preferably selected from ethanol, n- or i-propanol, butanols, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol monomethyl or monoethyl ether, diisopropylene glycol monomethyl or monoethyl ether, methoxy, ethoxy or butoxytriglycol, 1-butoxyethoxy-2-propanol, 3-methyl-3-methoxybutanol, propylene glycol t-butyl ether, alcohols, more particularly C1-4 alkanols, glycols, polyethylene glycols, preferably with a molecular weight of 100 to 100,000 and more particularly in the range from 200 to 10,000 and polyols, such as sorbitol and mannitol, and polyethylene glycol liquid at room temperature, carboxylic acid esters, polyvinyl alcohols, ethylene oxide/propylene oxide block copolymers and mixtures of the above.

$H_2O_2$ which is a preferred bleaching agent and compounds yielding $H_2O_2$ in water which serve as bleaching agents, sodium perborate tetrahydrate, sodium perborate monohydrate and sodium percarbonate are particularly important. Other useful bleaching agents are, for example, persulfates and mixed salts with persulfates, such as the salts commercially available as CAROAT®, peroxypyrophosphates, citrate perhydrates and $H_2O_2$-yielding peracidic salts or peracids, such as perbenzoates, peroxophthalates, diperazelaic acid, diperdodecanedioic acid or phthaloiminoperacids, such as phthaliminopercaproic acid.

Bleach systems which may be included in the detergent are preferably active chlorine carriers and/or organic or inorganic active oxygen carriers, bleach activators (e.g. TAED, TAGU, SNOBS (sodium nonoyl benzene sulphonate), PAG (penta acetyl glucose) or diacylated diperoxy carboxylic acids, bleach catalysts, enzymes for removing discolorations, perborates and/or percarbonates. The pH regulators are preferably sodium carbonate, citric acid, sodium citrate and/or bicarbonate.

The detergent may also comprise enzymes. Enzymes suitable for use in the dispersion are enzymes from the class of oxidases, proteases, lipases, cutinases, amylases, pullulanases, cellulases, hemicellulases, xylanases and peroxidases and mixtures thereof, for example proteases, such as BLAP®, Optimase®, Opticlean®, Maxacal®, Maxapem®, Alcalase®, Esperase® and/or Savinase®; amylases, such as Termamyl®, Amylase-LT®, Maxamyl®, Duramyl® and/or Purafect® OxAm; lipases, such as Lipolase®, Lipomax®, Lumafast® and/or Lipozym®; cellulases, such as Celluzyme® and/or Carazeme®. As described for example in European patent 0 564 476 or in International patent application WO 94/23005, the enzymes optionally used may be adsorbed onto supports and/or encapsulated in membrane materials to protect them against premature inactivation.

The invention also relates to an aqueous detergent dispersion obtainable from the method as defined herein. The invention also relates to an aqueous detergent dispersion comprising silanized colloidal silica particles and a detergent as described herein. The detergent and the silanized silica particles are preferably homogeneously dispersed in the aqueous phase.

The aqueous detergent dispersion may comprise up to about 80, preferably from about 0.01 to about 20, more preferably from about 0.1 to about 10, and most preferably from about 0.3 to about 5 wt % (dry) silica.

The aqueous detergent dispersion suitably has a detergent content from about 2 to about 80 wt %. The preferred detergent contents are as described herein.

The stability of the dispersion facilitates the handling and application thereof in any use since it allows for storage and need not be prepared on site immediately before usage. The already prepared dispersion can thus easily be directly used. The dispersion is also beneficial in the sense that it does not involve hazardous amounts of toxic solvents components. Preferably, the dispersion is substantially aqueous dispersion. However, according to one embodiment, a suitable organic solvent miscible with water may be comprised in the substantially aqueous dispersion in an amount from about 1 to about 20, preferably from about 1 to about 10, and most preferably from about 1 to about 5 volume percent of the total dispersion volume. This is due to the fact that for some applications, a certain amount of organic solvents may be present without any detrimental environmental effects.

The dispersion may contain besides silanized colloidal silica particles also, at least to some extent, non-silanized colloidal silica particles depending on the size of the silica particles, weight ratio of silane to silica, type of silane compound, reaction conditions etc. Suitably, at least about 40 of the colloidal silica particles are silanized (silane-modified), preferably at least about 65, more preferably at least about 90, and most preferably at least about 99 wt %. The dispersion may comprise besides silane in the form of silane groups or silane derivatives bound or linked to the surface of the silica particles also at least to some extent freely dispersed unbound silane compounds.

Suitably, at least about 40, preferably, at least about 60, more preferably at least about 75, even more preferably at least about 90, and most preferably at least about 95 wt % of the silane compounds are bound or linked to the surface of the silica particles.

Suitably, at least about 1% by number of the silanol surface groups on the colloidal silica particles are capable of binding or linking to silane groups on the silane compounds, preferably at least about 5%, more preferably at least about 10%, even more preferably at least about 30%, and most preferably at least about 50% bind or link to a silane group.

Preferably, the weight ratio of the total silane content to the total silica content in the dispersion is from about 0.01 to about 1.5, more preferably from about 0.05 to about 1, arid most preferably from about 0.1 to about 0.5. The total content of silica comprises silica in modified silanized silica particles and non-modified silica particles which also may be present in the prepared dispersion. The total content of silane is based on all freely dispersed silane and all linked or bound silane groups or derivatives.

The detergent dispersion can be used for the treatment of hard surfaces, but also for the treatment of fibre and textile surfaces.

Hard surfaces are, in particular, surfaces encountered in the home, i.e. surfaces of stone, ceramics, wood, plastics, metals, such as stainless steel, incl. floor coverings, such as carpets, etc. The cleaner dispersion can be of different types; e.g. glass cleaners, all purpose cleaners, bath cleaners, kitchen cleaners etc.

Textile surfaces include any synthetic and natural textiles, the particles used in accordance with the invention preferably being used for the treatment of cotton and cotton/wool blends in e.g. for the pretreatment and aftertreatment of textiles and for the washing of textiles. The particles may also be used for textile treatment in the textile industry, in which case they may be used both for the permanent and for the temporary treatment of textiles.

The detergent dispersion is preferably also used as hand dishwashing detergents, machine dishwashing detergents, machine dishwashing cleaners and rinse aids. The detergent dispersion may also be further used as automobile and paint cleaners for manual use and for automatic use in car washes. The detergent dispersion may also be used in anti-soil treatment for e.g. coil-coating.

The invention being thus described, it will be obvious that the same may be varied in many ways. Such variations are not to be regarded as a departure from the gist and scope of the present invention, and all such modifications as would be obvious to one skilled in the art are intended to be included within the scope of the claims. While the examples here below provide more specific details of the reactions, the following general principles may here be disclosed. The following examples will further illustrate how the described invention may be performed without limiting the scope of it.

All parts and percentages refer to part and percent by weight, if not otherwise stated.

EXAMPLES

Table 1 lists the liquid detergents used in the following examples.

TABLE 1

Liquid Detergents

| No | Name | Type - surface | Content | Content (%) |
|---|---|---|---|---|
| 1 | Ariel ® Colour(liquid) | Laundry detergent | Cat + Non, So, An | <5, 5 |
| 2 | Ajax ® Double Action | Glass cleaner(pH~8) | An | <5 |
| 3 | Ajax ® Allrengoring | APC (pH~7) | An + Non + So | <5 |
| 4 | DER GENERAL ® | APC(pH~10) | An + So, Non, H.A. | <5, 5-15, |

TABLE 1-continued

| Liquid Detergents | | | | |
|---|---|---|---|---|
| No | Name | Type - surface | Content | Content (%) |
| 5 | Ajax ® Mineral | Mineral surfaces(pH~7) | An + Non + So + Min | <5 |
| 6 | Ajax ® Kok | Kitchen Cleaner (pH~4) | An + Non + Amph | <5 |
| 7 | Ajax ® Badrum | Bath Cleaner (pH~2) | An + Non | <5 |
| 8 | Ajax ® Shower Power | Shower Cleaner(pH~11) | Amph + PC | <5 |

APC: All purpose cleaner
An: anionic surfactant
Non: nonionic surfactant
Cat: cationic surfactants
Amph: amphoteric surfactants
So: soap
Min: minerals
H.A.: higher alcohols
PC: polycarboxylates Table 2 lists the silica sols used in the following examples, some of which have been silane modified by addition of Silquest A-187 (gamma-glycidoxypropoxy-trimethoxysilane) available from General Electric Silicones. In the de-ionised silica sols, i.e. the major part of the anions and the cations has been removed by means of ion exchange. The silane modified de-ionised sol has been silane modified subsequent to the de-ionising process. The weight ratio of silane to silica as presented in table 2 is based on the dry content of silane and colloidal silica in the products.

TABLE 2

| Colloidal silica types (all sodium stabilised sols unless otherwise indicated) | | | | |
|---|---|---|---|---|
| No | Silica content (wt %) | Dp(nm) | Surface modification | Silane/silica |
| 1 | 15 | 3 | None | — |
| 2 | 12 | 3 | Silane | 0.8 |
| 3 | 15 | 5 | None | — |
| 4 | 27 | 5 | Silane | 0.4 |
| 5 | 30 | 7 | None | — |
| 6 | 25 | 7 | Aluminate | — |
| 7 | 30 | 7 | Silane | 0.08 |
| 8 | 30 | 7 | Silane | 0.20 |
| 9 | 30 | 12 | Aluminate | — |
| 10 | 37 | 12 | Silane | 0.15 |
| 11 | 34 | 14 | none, de-ionised, pH 2 | — |
| 12 | 30 | 14 | silane, de-ionised, pH 2 | 0.29 |

The particle size $D_P$ for each sol in table 2 is based on the specific surface area on the non-modified sol for each particle size respectively.

Example 1

The colloidal silica dispersions as listed in table 2 were added to the liquid detergents as listed in table 1 under good agitation in accordance with table 3. The amount of detergent, to which the colloidal silica dispersion is added, is 100 g if not stated otherwise. The stability is controlled initially and finally after one month's storage at 55° C. for precipitation and separation (inhomogeneous sample). The stability was controlled by optical inspection.

TABLE 3

| Detergent dispersions and stability | | | | | |
|---|---|---|---|---|---|
| No | Sol | Amount of added sol product (g) | Detergent (as in table 1) | Initial Stability | Final Stability (one month, 55° C.) |
| 1 | 5 | 1.0 | 1 | OK | precipitated* (separation) |
| 2 | 8 | 1.0 | 1 | OK | OK** |
| 3 | 5 | 2.0 | 2 | precipitated | — |
| 4 | 6 | 2.4 | 2 | OK | precipitated |
| 5 | 7 | 2.0 | 2 | OK | OK |
| 6 | 8 | 2.0 | 2 | OK | OK |
| 7 | 5 | 2.0 | 3 | precipitated | — |
| 8 | 8 | 2.0 | 3 | OK | OK |
| 9 | 9 | 3.3 | 4 | OK | precipitated (26 d, 20° C.) |
| 10 | 8 | 3.3 | 4 | OK | OK |
| 11 | 5 | 2.0 | 5 | precipitated | — |
| 12 | 8 | 2.0 | 5 | OK | OK |
| 13 | 5 | 2.0 | 6 | precipitated | — |
| 14 | 9 | 10.0 | 6 | OK | precipitated |
| 15 | 10 | 8.0 | 6 | OK | OK |
| 16 | 5 | 10.0 | 7 | precipitated | — |
| 17 | 6 | 12.0 | 7 | OK | precipitated (1 day) |
| 18 | 8 | 10.0 | 7 | OK | OK |
| 19 | 12 | 2.0 | 7 | OK | OK |
| 20 | 12 | 10.0 | 7 | OK | OK |
| 21 | 6 | 2.4 | 8 | precipitated | — |
| 22 | 3 | 4.0 | 8 | precipitated | — |
| 23 | 4 | 2.2 | 8 | OK | OK |
| 24 | 1 | 4.0 | 8 | precipitated | — |
| 25 | 2 | 5.0 | 8 | OK | OK |
| 26 | 11 | 8.8 | 8 | precipitated | — |
| 27 | 12 | 10.0 | 8 | OK | OK |

*19 days at room-temperature
**70 days at room-temperature

From table 3, it can be clearly seen that the detergent dispersions comprising silane-modified silica sols were much more stable than the non-modified silica-based detergent dispersions.

Example 2

The performance of the silane modified sols in the detergent application had the same technical effect as can be seen from table 4 below.

1.5 g silica sol aqueous product was added to 100 g Ajax Double Action (glass cleaner) at good agitation at room temperature. The cleaner was then used as described in the method below.

Method: Exterior windows were used in the test. The detergents (with the silica sol) were sprayed onto vertical windows and the surplus was then removed by a rubber scraper. The windows were let to dry for 5 minutes. Standard soil (Krefeld) solution (1%) was sprayed onto a part of the cleaned window. Water was also sprayed onto another part of the cleaned window. The spread and wetting of the soil were studied (spread and soil release). The hydrophily was indicated by the wetting of the sprayed water. The windows were let to dry for another 5 minutes. Water was sprayed onto the windows. The soil removal was studied. As can be clearly seen in table 4, the soil removal, release, and spread of detergent dispersions 2-4 are much better than reference 1 without silica sol.

TABLE 4

| No | Sol | Hydrophily | Soil Release | Spread | Soil Removal |
|---|---|---|---|---|---|
| 1 | — | 1 | 1 | 1 | 1 |
| 2 | 5 | 5 | 5 | 5 | 5 |
| 3 | 7 | 5 | 5 | 5 | 5 |
| 4 | 8 | 5 | 5 | 5 | 5 |

Scale:
1: reference
2: slightly better than reference
3: better than reference
4: significantly better than reference
5: much better than reference

The invention claimed is:

1. A method of preparing an aqueous detergent dispersion comprising mixing at least one silane compound and colloidal silica particles in an aqueous dispersion in a weight ratio of silane to silica of about 0.1 to about 1.5, optionally comprising an organic solvent miscible with water, wherein no organosiloxane or silicone are admixed for preparing a silicone coat on any silica particles or silane-modified silica particles to form an aqueous dispersion of silanized colloidal silica particles, adding a detergent comprising at least one anionic and/or non-ionic surfactant to said dispersion to form an aqueous detergent dispersion comprising silanized colloidal silica particles, wherein said detergent is added in an amount resulting in a detergent content from about 2 to about 80 wt % based on the detergent dispersion, wherein the total amount of organic solvent miscible with water, if present, is present in an amount of about 20 volume % or less based on the total dispersion volume.

2. A method according to claim 1, wherein said at least one silane compound is an epoxy silane.

3. A method according to claim 1, wherein said at least one silane compound is an epoxy silane with a glycidoxy group.

4. A method according to claim 1, wherein said at least one silane compound is mixed with the silica particles in a weight ratio of silane to silica of about 0.1 to about 1.

5. An aqueous detergent dispersion obtained by mixing at least one silane compound and colloidal silica particles in an aqueous dispersion in a weight ratio of silane to silica of about 0.1 to about 1.5, wherein no organosiloxane or silicone are admixed for preparing a silicone coat on any silica particles or silane-modified silica particles, optionally comprising an organic solvent miscible with water in an amount from about 1 to about 20 volume % of the total dispersion volume, to form an aqueous dispersion of silanized colloidal silica particles, adding a detergent comprising at least one anionic and/or non-ionic surfactant to said dispersion to form an aqueous detergent dispersion comprising silanized colloidal silica particles, wherein the detergent content in said dispersion is from about 2 to about 80 wt %.

6. An aqueous detergent dispersion optionally comprising an organic solvent miscible with water in an amount from about 1 to about 20 volume % of the total dispersion volume comprising silanized colloidal silica particles and a detergent comprising at least one anionic and/or non-ionic surfactant having a content of from about 2 to about 80 wt % based on the weight of the dispersion wherein the weight ratio of silane to silica ranges from about 0.1 to about 1.5, and wherein no organosiloxane or silicone are comprised.

7. A dispersion according to claim 5, wherein the silica content is from about 0.01 to about 20 wt %.

8. A dispersion according to claim 6, wherein the silica content is from about 0.01 to about 20 wt %.

9. A dispersion according to claim 6, wherein the dispersion is obtained by mixing at least one silane compound and colloidal silica particles in an aqueous dispersion.

10. A method according to claim 1, wherein said detergent content is from about 2 to about 10 wt %.

11. A method according to claim 1, wherein said detergent content is from about 30 to about 50 wt %.

12. A method according to claim 1, wherein said detergent content is from about 50 to about 80 wt %.

13. A method according to claim 1, wherein no organosiloxane or silicone is admixed in said aqueous dispersion.

14. A method according to claim 1, wherein said colloidal silica particles have an average particle diameter ranging from about 2 to about 150 nm and a relative standard deviation of particle size distribution lower than about 60% by numbers.

15. A method according to claim 14, wherein said average particle diameter ranges from about 3 to about 50 nm and a relative standard deviation of particle size distribution lower than about 30% by numbers.

16. A method according to claim 4, wherein the weight ratio of silane to silica is from about 0.1 to about 0.5.

17. A method according to claim 4, wherein said detergent dispersion remains stable for at least one month at about 55° C.

18. A method according to claim 1, wherein the silica content is from about 0.01 to about 20 wt %.

19. A method according to claim 1, wherein the aqueous detergent dispersion is prepared with the proviso that no organosiloxane or silicone is admixed in the aqueous dispersion for preparing a silicone coat on silica particles or silane-modified silica particles.

20. A method according to claim 1, wherein the colloidal silica particles are added in the form of an aqueous silica sol having an S-value from about 60 to about 90.

* * * * *